US008543039B2

(12) United States Patent
Onishi

(10) Patent No.: US 8,543,039 B2
(45) Date of Patent: Sep. 24, 2013

(54) IMAGE FORMING APPARATUS

(75) Inventor: Akihito Onishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 346 days.

(21) Appl. No.: 12/979,765

(22) Filed: Dec. 28, 2010

(65) Prior Publication Data

US 2011/0164900 A1 Jul. 7, 2011

(30) Foreign Application Priority Data

Jan. 7, 2010 (JP) ..... 2010-002333

(51) Int. Cl.
*G03G 15/01* (2006.01)

(52) U.S. Cl.
USPC ..... 399/223

(58) Field of Classification Search
USPC ..... 399/223, 94.223
See application file for complete search history.

(56) References Cited

U.S. PATENT DOCUMENTS

2009/0092421 A1* 4/2009 Sato ..... 399/280

FOREIGN PATENT DOCUMENTS

| | | | |
|---|---|---|---|
| JP | 09-138563 | A | 5/1997 |
| JP | 09-319179 | A | 12/1997 |
| JP | 10-010858 | A | 1/1998 |
| JP | 11-258902 | A | 9/1999 |
| JP | 2004-101933 | A | 4/2004 |
| JP | 2004-245995 | A | 9/2004 |
| JP | 2008-058677 | A | 3/2008 |
| JP | 2008-203600 | A | 9/2008 |
| JP | 2009-122241 | A | 6/2009 |
| JP | 2009-169350 | A | 7/2009 |
| JP | 2009-288357 | A | 12/2009 |

* cited by examiner

*Primary Examiner* — Walter L Lindsay, Jr.
*Assistant Examiner* — Frederick Wenderoth
(74) *Attorney, Agent, or Firm* — Kubotera & Associates LLC

(57) ABSTRACT

An image forming apparatus includes a first image forming portion for forming a developer image, said first image forming portion including a first image supporting member for forming a static latent image and a first developing member for attaching developer to the static latent image; a second image forming portion for forming a developer image, said second image forming portion including a second image supporting member for forming a static latent image and a second developing member for attaching developer to the static latent image; a transfer portion for transferring the developer image to a printing medium; and a fixing unit for fixing the developer image to the printing medium. The second developing member has a surface roughness greater than that of the first developing member. The fixing unit is disposed at a position closer to the first image forming portion relative to the second image forming portion.

13 Claims, 10 Drawing Sheets

| | First embodiment | | | | Comparative examples | | | |
|---|---|---|---|---|---|---|---|---|
| | | | | | No. 1 | No. 2 | No. 3 | No. 4 |
| Unit position | No.1 | No. 2 | No. 3 | No. 4 | No.1 | No. 2 | No. 3 | No. 4 |
| Toner color | Cyan | Cyan | Cyan | Cyan | Cyan | Cyan | Cyan | Cyan |
| Surface roughness (μm) | 2 | 2 | 2 | 2 | 4.2 | 4.2 | 4.2 | 4.2 |
| Elastic layer hardness | 78 | 78 | 78 | 78 | 78 | 78 | 78 | 78 |
| Surface temperature (C°) | 52 | 47 | 45 | 42 | 52 | 47 | 45 | 42 |
| Toner amount ($mg/cm^2$) | 0.73 | 0.7 | 0.6 | 0.25 | 0.86 | 0.8 | 0.72 | 0.66 |
| Grayness level | 6 | 7 | 8 | 6 | 3 | 4 | 6 | 7 |
| Blurred image | ○ | ○ | ○ | × | ○ | ○ | ○ | ○ |

FIG. 7

| | Second embodiment | Modified example No. 1 of second embodiment | First embodiment | Comparative example No. 1 |
|---|---|---|---|---|
| Unit position | No. 1 | No. 1 | No. 1 | No. 1 |
| Toner color | Cyan | Cyan | Cyan | Cyan |
| Surface roughness (μm) | 2 | 4.2 | 2 | 4.2 |
| Elastic layer hardness | 70 | 70 | 78 | 78 |
| Surface temperature (C°) | 52 | 52 | 52 | 52 |
| Toner amount (mg/cm$^2$) | 0.62 | 0.67 | 0.73 | 0.86 |
| Grayness level | 7 | 7 | 6 | 3 |

FIG. 8

| | Third embodiment | First embodiment | Second embodiment | Comparative example No. 1 |
|---|---|---|---|---|
| Unit position | No. 1 | No. 1 | No. 1 | No. 1 |
| Toner color | Yellow | Cyan | Cyan | Cyan |
| Surface roughness (μm) | 2 | 2 | 2 | 4.2 |
| Elastic layer hardness | 70 | 78 | 70 | 78 |
| Surface temperature (C°) | 52 | 52 | 52 | 52 |
| Toner amount (mg/cm$^2$) | 0.62 | 0.73 | 0.62 | 0.86 |
| Grayness level | 10 | 6 | 7 | 3 |
| Nip marks | 10 | 10 | 8 | 10 |

FIG. 10

IMAGE FORMING APPARATUS

BACKGROUND OF THE INVENTION AND RELATED ART STATEMENT

The present invention relates to an image forming apparatus. In particular, the present invention relates to an image forming apparatus capable of preventing print quality from lowering even when an amount of toner on a developing roller increases due to heat of a fixing unit.

In a conventional image forming apparatus, a developing roller is provided for attaching toner to a photosensitive drum. A layer regulating member formed of a metal plate spring member is arranged to contact with a surface of the developing roller. A temperature sensor is disposed on the layer regulating member for detecting a surface temperature of the developing roller, so that various operations of the conventional image forming apparatus such as a driving operation, a termination operation, and a low speed operation can be controlled according to the surface temperature (Refer to Patent Reference).

Patent Reference: Japanese Patent Publication No. 2008-203600

In the conventional image forming apparatus described above, an amount of toner may increase due to heat of the developing roller. In this case, a printing abnormality may occur due to an excessive amount of toner, thereby deteriorating image quality.

In view of the problems described above, an object of the present invention is to provide an image forming apparatus capable of solving the problems of the conventional image forming apparatus.

Further objects and advantages of the invention will be apparent from the following description of the invention.

SUMMARY OF THE INVENTION

In order to attain the objects described above, according to a first aspect of the present invention, an image forming apparatus includes a first image forming portion for forming a developer image, said first image forming portion including a first image supporting member for forming a static latent image and a first developing member for attaching developer to the static latent image; a second image forming portion for forming a developer image, said second image forming portion including a second image supporting member for forming a static latent image and a second developing member for attaching developer to the static latent image; a transfer portion for transferring the developer image to a printing medium; and a fixing unit for fixing the developer image to the printing medium. The second developing member has a surface roughness greater than that of the first developing member. The fixing unit is disposed at a position closer to the first image forming portion relative to the second image forming portion.

According to a second aspect of the present invention, an image forming apparatus includes a first image forming portion for forming a developer image, said first image forming portion including a first image supporting member for forming a static latent image and a first developing member for attaching developer to the static latent image; a second image forming portion for forming a developer image, said second image forming portion including a second image supporting member for forming a static latent image and a second developing member for attaching developer to the static latent image; a transfer portion for transferring the developer image to a printing medium; and a fixing unit for fixing the developer image to the printing medium. The second developing member has a hardness greater than that of the first developing member. The fixing unit is disposed at a position closer to the first image forming portion relative to the second image forming portion.

According to a third aspect of the present invention, an image forming apparatus includes a first image supporting member for forming a static latent image; a first developing member for attaching developer to the static latent image to form a visualized image; a second image supporting member for forming a static latent image; a second developing member for attaching developer to the static latent image to form a visualized image; and a fixing unit for heating and fixing the visualized image to a printing medium. The second developing member has transportability of the developer greater than that of the first developing member. The fixing unit is disposed at a position closer to the first developing member relative to the second developing member.

BRIEF DESCRIPTION OF THE DRAWINGS

FIG. 7 is a table showing evaluation results of the image forming apparatus according to the first embodiment of the present invention;

FIG. 8 is a table showing evaluation results of an image forming apparatus according to a second embodiment of the present invention;

FIG. 10 is a table showing evaluation results of the image forming apparatus according to the third embodiment of the present invention.

DETAILED DESCRIPTION OF PREFERRED EMBODIMENTS

Hereunder, embodiments of the present invention will be explained with reference to the accompanying drawings.

First Embodiment

Figure 1:
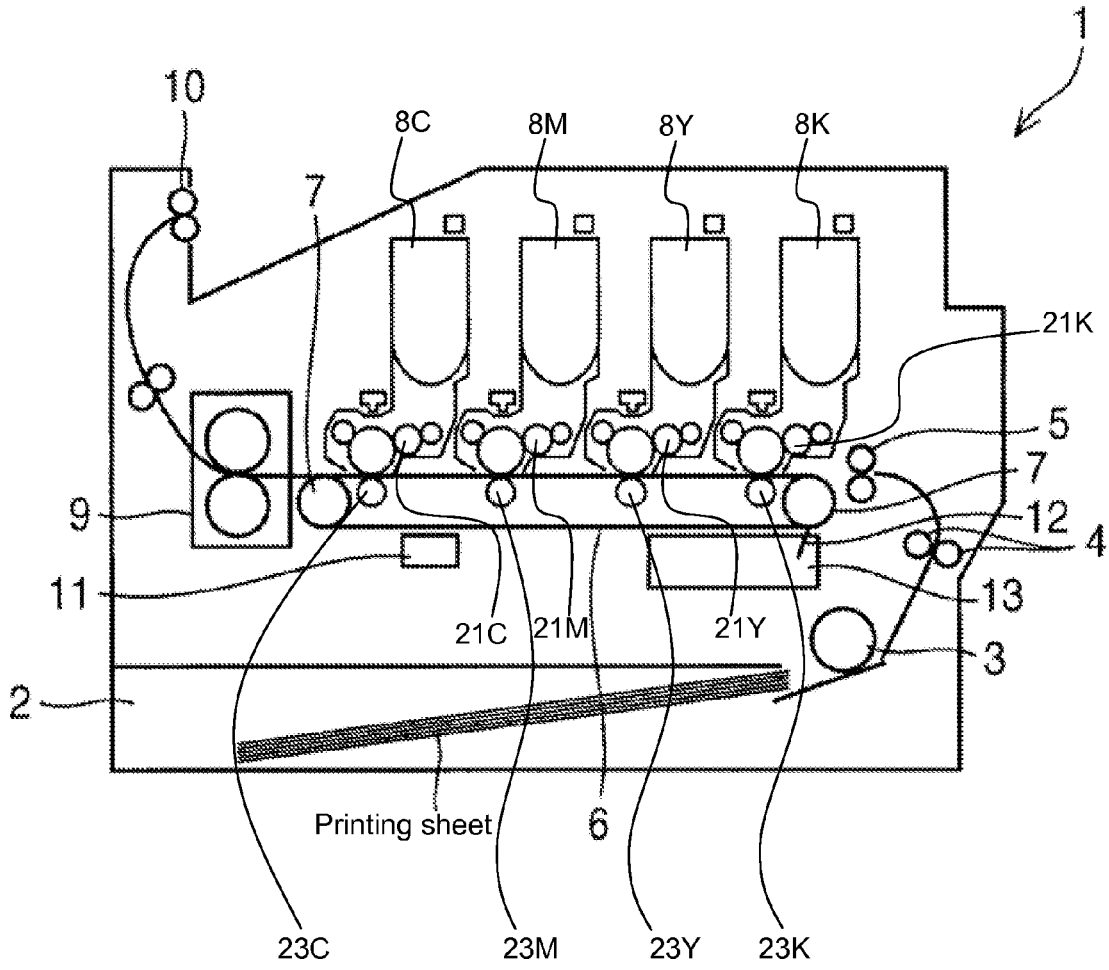
FIG. 1 is a schematic sectional view showing a configuration of an image forming apparatus according to a first embodiment of the present invention.

A first embodiment of the present invention will be explained. FIG. 1 is a schematic sectional view showing a configuration of an image forming apparatus 1 according to the first embodiment of the present invention.

As shown in FIG. 1, the image forming apparatus 1 includes a sheet supply cassette 2 for retaining a printing sheet as a printing medium in a stacked state. A sheet supply roller 3 is disposed at a position facing a bottom surface of the sheet supply cassette 2 for picking up and transporting the printing sheet retained in the sheet supply cassette 2.

In the embodiment, the sheet supply cassette 2 is configured such that the bottom surface thereof is urged with an elastic member such as a spring to be capable of lifting the printing sheet retained in the sheet supply cassette 2. Accordingly, the printing sheet at the upper most position is closely contacted with the sheet supply roller 3. As a result, when the sheet supply roller 3 rotates, the printing sheet is picked up from the sheet supply cassette 2.

In the embodiment, a transportation roller 4 is provided for sandwiching and transporting the printing sheet transported from the sheet supply roller 3. A register roller 5 is provided for correcting skew of the printing sheet when the transportation roller 4 transports the printing sheet in a skewed state.

In the embodiment, a sheet transportation belt 6 is disposed at a downstream side of the register roller 5 in a transportation direction of the printing sheet for supporting the printing sheet from below. The sheet transportation belt 6 is formed of an endless belt arranged around two belt rollers 7 along the transportation direction. When a drive source (not shown) drives one of the belt rollers 7 to rotate, the sheet transportation belt 6 rotates and transports the printing sheet.

In the embodiment, the image forming apparatus 1 includes image forming units 8 (8C, 8M, 8Y, and 8K) as an electro-photographic printing mechanism for attaching toner in colors of cyan, magenta, yellow, and black to the printing sheet. An image in each color is overlapped with each other to form a color print image.

As shown in FIG. 1, the image forming units 8C, 8M, 8Y, and 8K retaining toner as developer in the colors of cyan, magenta, yellow, and black, respectively, are disposed at a first position (a position No. 1), a second position (a position No. 2), a third position (a position No. 3), and a fourth position (a position No. 4), respectively, in an order of close proximity from a fixing unit 9. Further, developing rollers 21C, 21M, 21Y, and 21K are disposed in the image forming units 8C, 8M, 8Y, and 8K, respectively.

In the embodiment, the image forming unit 8C retaining toner in cyan is situated at the first position as a first image forming portion. Further, the image forming unit 8K retaining toner in black is situated at the fourth position as a second image forming portion. In other words, the image forming unit 8K retaining toner in black is situated at the farthest position from the fixing unit 9. A configuration of the image forming units 8 will be explained in more detail later.

In the embodiment, the image forming apparatus 1 further includes the fixing unit 9 as a fixing portion disposed on a downstream side of the image forming units 8 in the transportation direction of the printing sheet. The fixing unit 9 includes a fixing roller having a halogen lamp for contacting the sheet printing sheet from above and a backup roller for receiving a pressing force from the fixing roller to follow and rotate with the fixing roller. When the halogen lamp is turned on, the fixing roller is heated up. The fixing roller and the backup roller are arranged to sandwich the printing sheet, so that toner attached to the printing sheet is melted, thereby fixing toner to the printing sheet.

In the embodiment, the image forming apparatus 1 further includes a discharge roller 10. After the fixing unit 9 fixes toner to the printing sheet, the discharge roller 10 transports the printing sheet to an outlet (not shown) of the image forming apparatus 1, so that the printing sheet is discharged outside the image forming apparatus 1.

In the embodiment, the image forming apparatus 1 further includes a temperature sensor unit 11 disposed below the sheet transportation belt 6 for measuring a surface temperature of the sheet transportation belt 6. More specifically, the image forming apparatus 1 is configured such that the temperature sensor unit 11 measures the surface temperature of the sheet transportation belt 6, so that a temperature of the image forming units 8 is estimated. Further, when the temperature of the image forming units 8 exceeds a specific level, the image forming apparatus 1 is configured to control a printing operation thereof such that the printing operation is slowed or stopped, so that the temperature of the image forming units 8 does not become too high to properly perform the printing operation.

In the embodiment, the image forming apparatus 1 further includes a cleaning blade 12 for scraping off and removing toner on the sheet transportation belt 6. A waste toner storage unit 13 is provided for collecting toner scraped off with the cleaning blade 12 from the sheet transportation belt 6.

Figure 2:
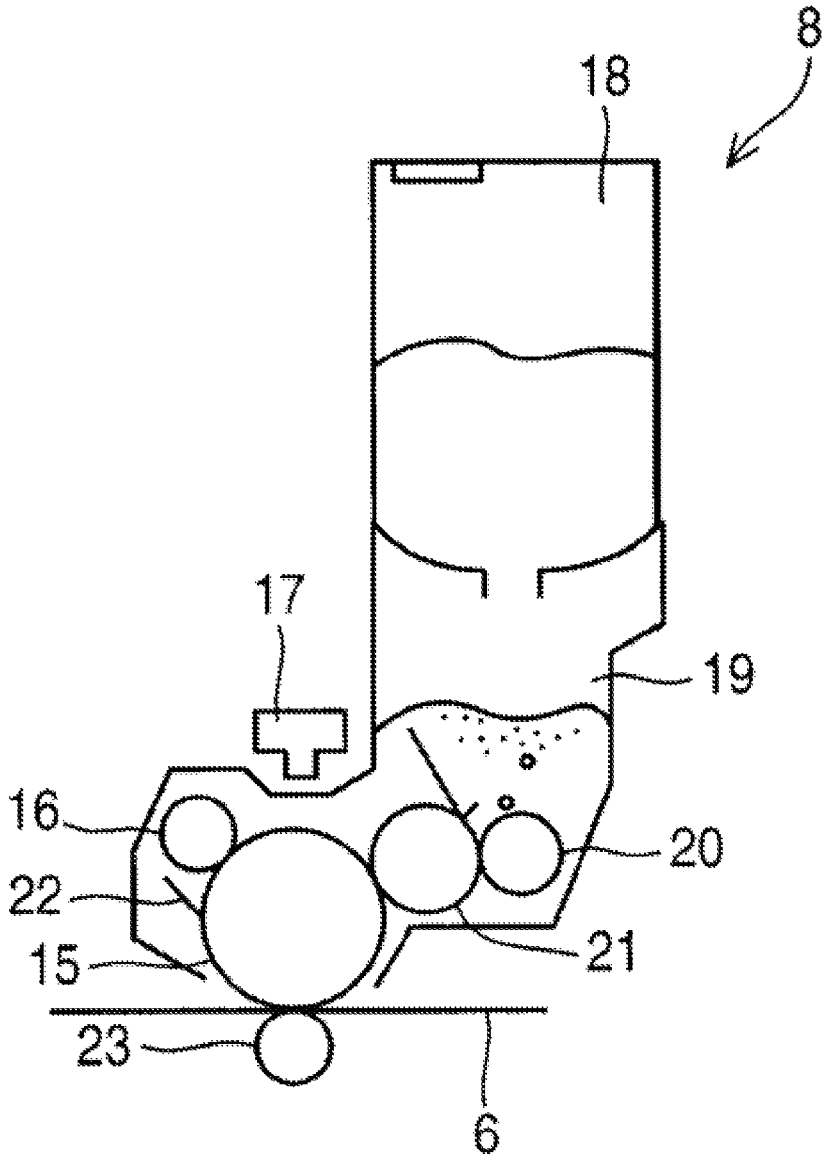
FIG. 2 is a schematic sectional view showing a configuration of an image forming unit of the image forming apparatus according to the first embodiment of the present invention.

A configuration of the image forming unit 8 will be explained next. FIG. 2 is a schematic sectional view showing a configuration of the image forming unit 8 of the image forming apparatus 1 according to the first embodiment of the present invention.

As shown in FIG. 2, the image forming unit 8 as the image forming portion includes a photosensitive drum 15 (an image supporting member); a charging roller 16; an LED (Light Emitting Diode) head 17; a toner cartridge 18; a toner storage portion 19; a toner supply roller 20; the developing roller 21 (a developing member); and a cleaning unit 22.

In the embodiment, the photosensitive drum 15 is provided for forming a static latent image thereon, and is arranged to face the sheet transportation belt 6 and contact with the printing sheet transported from below. The charging roller 16 is formed of a conductive material and is supplied with a charging voltage with a negative polarity. The charging roller 16 is arranged to contact with the photosensitive drum 15, so that the charging roller 16 charges the photosensitive drum 15 with a specific potential.

In the embodiment, the LED head 17 is provided for irradiating and exposing a surface of the photosensitive drum 15 to form the static latent image on the photosensitive drum 15. More specifically, the LED head 17 irradiate the surface of the photosensitive drum 15 such that an area of the static latent image has a lower negative electric potential.

In the embodiment, the image forming unit 8 has an attachment opening at an upper portion thereof. When the toner cartridge 18 is attached to the image forming unit 8, the toner cartridge 18 is turned upside down, so that an opening portion of the toner cartridge 18 is aligned with the attachment opening of the image forming unit 8. After the toner cartridge 18 is attached to the image forming unit 8, toner inside the toner cartridge 18 is supplied and retained in the toner storage portion 19. It is supposed that toner is charged with a negative polarity.

In the embodiment, toner inside the toner storage portion 19 attaches to the toner supply roller 20. When the toner supply roller 20 rotates, the toner supply roller 20 attaches and supplies toner to the developing roller 21 disposed adjacent to the toner supply roller 20. Then, the developing roller 21 supplies toner to the photosensitive drum 15, so that toner is attached to the static latent image on the photosensitive drum 15, thereby forming a visualized image with toner on the photosensitive drum 15.

In the embodiment, the cleaning unit 22 includes a brash, a blade formed of a rubber, and the like. After toner is transferred to the printing sheet, the cleaning unit 22 collects toner remaining on the surface of the photosensitive drum 15.

In the embodiment, the image forming unit 8 further includes a transfer roller 23 as a transfer portion at a position to face the photosensitive drum 15 with the sheet transportation belt 6 in between. The transfer roller 23 is charged with a negative polarity, and is arranged to sandwich the printing sheet with the photosensitive drum 15. Accordingly, the transfer roller 23 attracts toner with the negative electric charges, so that toner is transferred to the printing sheet, thereby forming a toner image.

Figure 3:
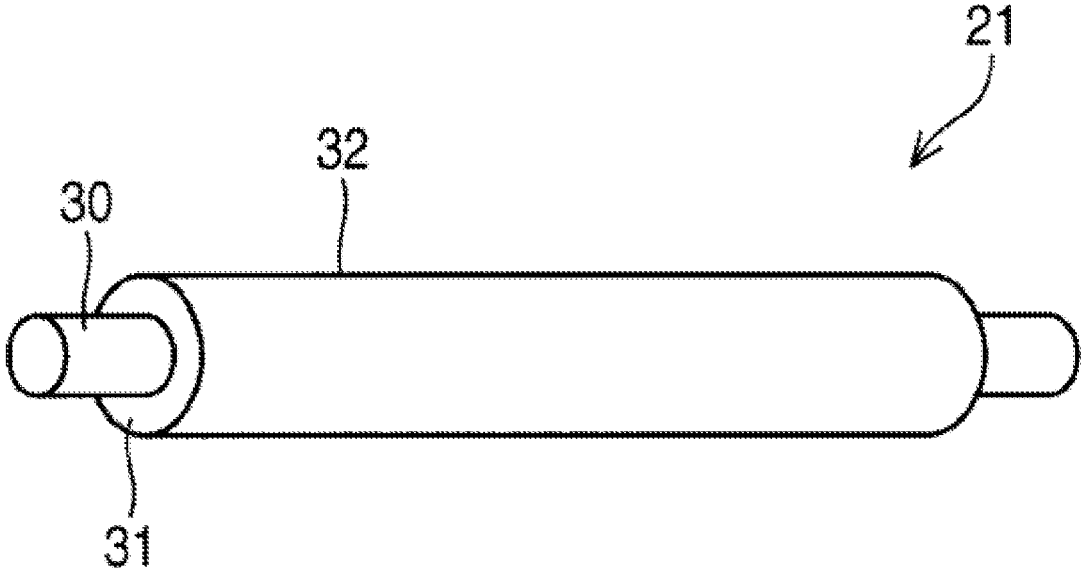
FIG. 3 is a schematic perspective view showing a developing roller of the image forming apparatus according to the first embodiment of the present invention.

A configuration of the developing roller 21 will be explained next. FIG. 3 is a schematic perspective view showing the developing roller 21 of the image forming apparatus 1 according to the first embodiment of the present invention.

As shown in FIG. 3, the developing roller 21 is formed of a conductive shaft 30 as a center shaft and a roller main body 31 as a conductive elastic member formed of a carbon conductive urethane rubber and the like. The roller main body 31 or the conductive elastic member has a hardness (an elastic layer hardness) of 78° according to an Asker C-type measurement device.

In the embodiment, the developing roller 21 has an undulated surface processed with a grinding stone, sandpaper, and the like. It is configured such that toner enters and is attached to the undulated surface, so that the developing roller 21 physically transports toner.

In the embodiment, the developing roller 21 has the undulated surface through the grinding method, and the method is not limited thereto. For example, roughening particles may be added in the roller main body 31 to form the undulated surface. Further, the roller main body 31 may be formed using a die metal having an undulated surface, so that the undulated surface of the die metal is transferred to the roller main body 31 to form the undulated surface.

Figure 4:
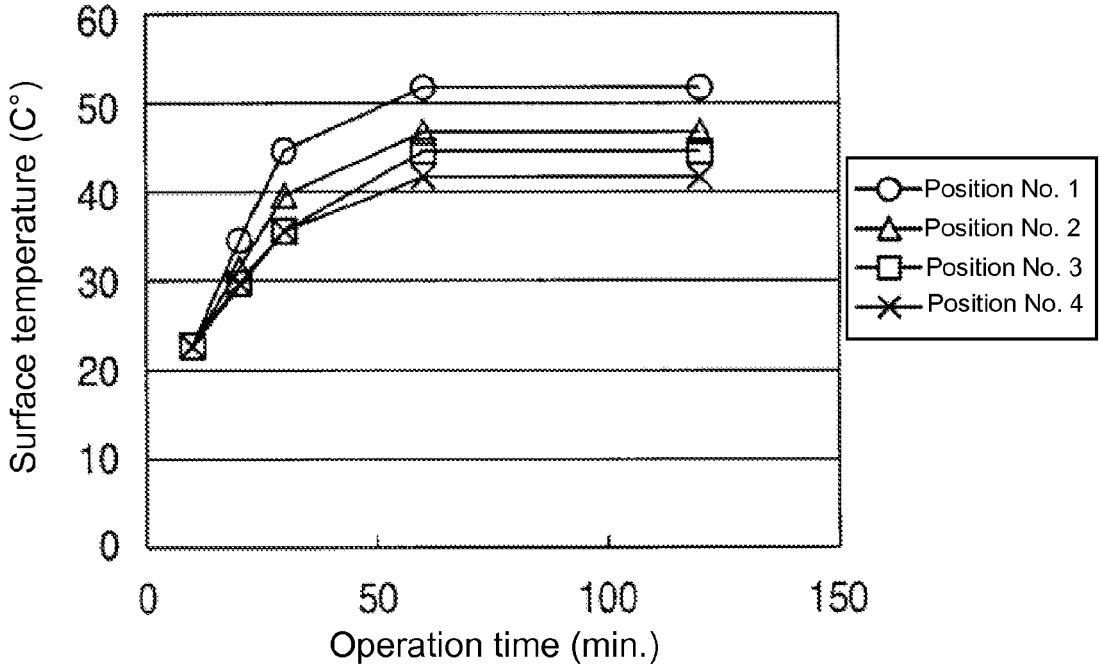
FIG. 4 is a graph showing a relationship between an operation time and a surface temperature of the developing roller of the image forming apparatus according to the first embodiment of the present invention.

An experiment for evaluating the image forming apparatus 1 will be explained next. FIG. 4 is a graph showing a relationship between an operation time and a surface temperature of the developing roller 21 of the image forming apparatus 1 according to the first embodiment of the present invention.

In the experiment, a roller temperature sensor (not shown) was disposed in the image forming unit 8 for measuring a surface temperature of the developing roller 21, and the image forming apparatus 1 was operated under an environmental temperature of 23° C.

As described above, the image forming units 8 are disposed in the image forming apparatus 1. In order to differentiate each of the developing rollers 21, it was supposed that the developing rollers 21 were situated at four positions as shown in FIG. 1, according to a distance from the fixing unit 9. More specifically, the developing rollers 21 were situated at the first position (the position No. 1), the second position (the position No. 2), the third position (the position No. 3), and the fourth position (the position No. 4) in an order of close proximity from the fixing unit 9.

In FIG. 4, the developing roller 21 situated at the first position closest to the fixing unit 9 was represented with a symbol "○"; the developing roller 21 situated at the second position was represented with a symbol "Δ"; the developing roller 21 situated at the third position was represented with a symbol "□"; and the developing roller 21 situated at the fourth position was represented with a symbol "X".

As described above, the image forming units 8C, 8M, 8Y, and 8K retaining toner as developer in the colors of cyan, magenta, yellow, and black, respectively, are disposed at the first position, the second position, the third position, and the fourth position, respectively. The developing rollers 21C, 21M, 21Y, and 21K are disposed in the image forming units 8C, 8M, 8Y, and 8K, respectively.

In the embodiment, the printing sheet supplied from the sheet supply roller 3 is transported toward the fixing unit 9. The image forming unit 8C is disposed on an upstream side of the fixing unit 9 and a downstream side of the image forming units 8M, 8Y, and 8K.

In the experiment, as shown in FIG. 4, after the image forming apparatus 1 started the operation, the surface temperature of the developing roller 21 increased at a higher rate in an order of the first position, the second position, the third position, and the fourth position, that is, the position closer to the fixing unit 9. After a specific period of time, the surface temperature of the developing roller 21 stopped increasing and became flat at a specific level. The flat level of the surface temperature of the developing roller 21 was higher in the order of the first position, the second position, the third position, and the fourth position, that is, the position closer to the fixing unit 9.

More specifically, the surface temperature of the developing roller 21 was saturated at a temperature of about 52° C. at the first position; at a temperature of about 47° C. at the second position; at a temperature of about 45° C. at the third position; and at a temperature of about 42° C. at the fourth position.

Figure 5:
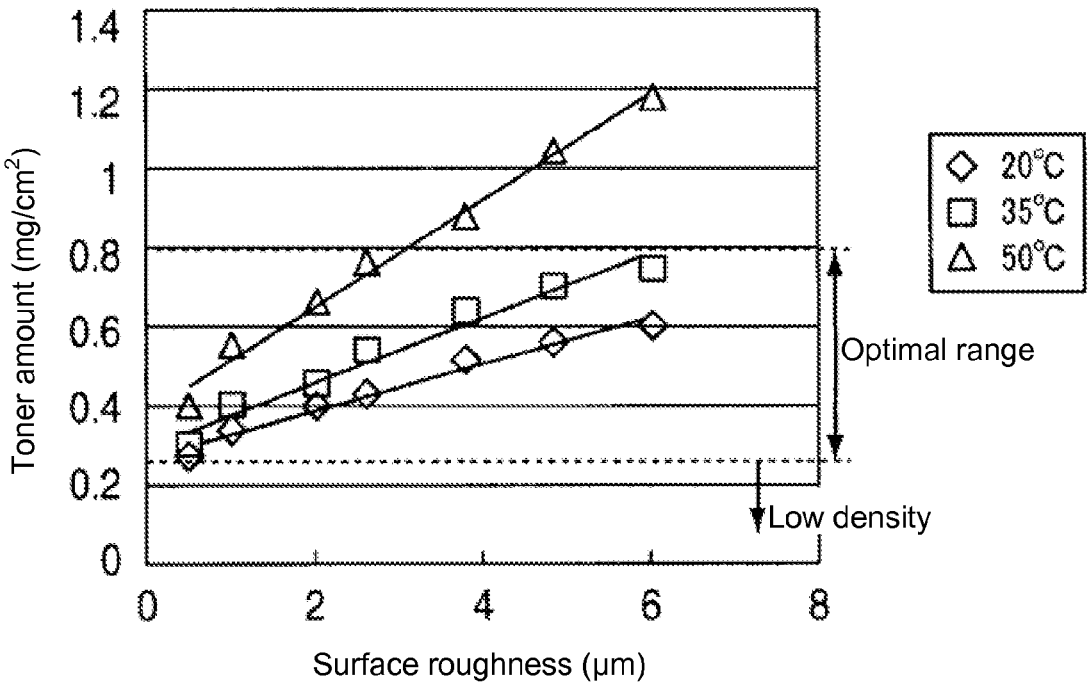
FIG. 5 is a graph showing a relationship between a toner amount and a surface roughness of the developing roller of the image forming apparatus according to the first embodiment of the present invention.

In the experiment, a relationship between a toner amount and a surface roughness of the developing roller 21 of the image forming apparatus 1 was evaluated. FIG. 5 is a graph showing the relationship between the toner amount and the surface roughness of the developing roller 21 of the image forming apparatus 1 according to the first embodiment of the present invention. In the experiment, the developing rollers 21 with different surface roughness were evaluated. The image forming apparatus 1 performed the printing operation at a duty of 1.6% (A4).

In the experiment, an amount of toner attached to the developing roller 21 (the toner amount) was measured according to the surface temperature of the developing roller 21. More specifically, the surface temperatures of the developing roller 21 were 20° C., 35° C., or 50° C. In FIG. 5, the relationship between the toner amount and the surface roughness at the surface temperature of 20° C. was represented with a symbol "◇"; the relationship between the toner amount and the surface roughness at the surface temperature of 35° C. was represented with a symbol "□"; and the relationship between the toner amount and the surface roughness at the surface temperature of 50° C. was represented with a symbol "Δ".

In the experiment, while the developing roller 21 was rotating at a speed of 0.1 mm/sec., a ten-point surface roughness was measured using a surface roughness contour shape measurement device (SEF3500, a product of Kosaka Laboratory Ltd.) under conditions of a contact radius of 2 μm; a contact probe pressure of 0.7 mN; a measurement length of 2.5 mm, a high region cutoff λc of 0.8 mm; and a low region cutoff λs of 2.5 μm according to JIS B06-1994. The ten-point surface roughness was measured at three locations of the developing roller 21 along a longitudinal direction thereof, and the surface roughness Rz was calculated as an average value of the ten-point surface roughness at the three locations.

In the experiment, a metal piece having an area of 1 $cm^2$ was contacted with the surface of the developing roller 21. Then, a voltage of 300 V was applied to the metal piece, so that toner on the surface of the developing roller 21 was scraped off. An amount of toner thus scraped off was measured as the toner amount (mg/cm$^2$) on the surface of the developing roller 21.

As shown in FIG. 5, the toner amount increased with the surface temperature of the developing roller 21. Further, the toner amount increased with the surface roughness of the developing roller 21. When the surface roughness of the developing roller 21 decreased, an amount of toner entered a recess portion of the undulated surface of the developing roller 21 decreased. Accordingly, the developing roller 21 was not able to physically carry a large amount of toner through the surface roughness, thereby decreasing the toner amount.

Further, in the experiment, when the toner amount was less than 0.3 mg/cm$^2$, a density of toner decreased. Accordingly, it was difficult to perform the printing operation with acceptable quality due to a thin image or a blurred image formed on the printing sheet.

Figure 6:
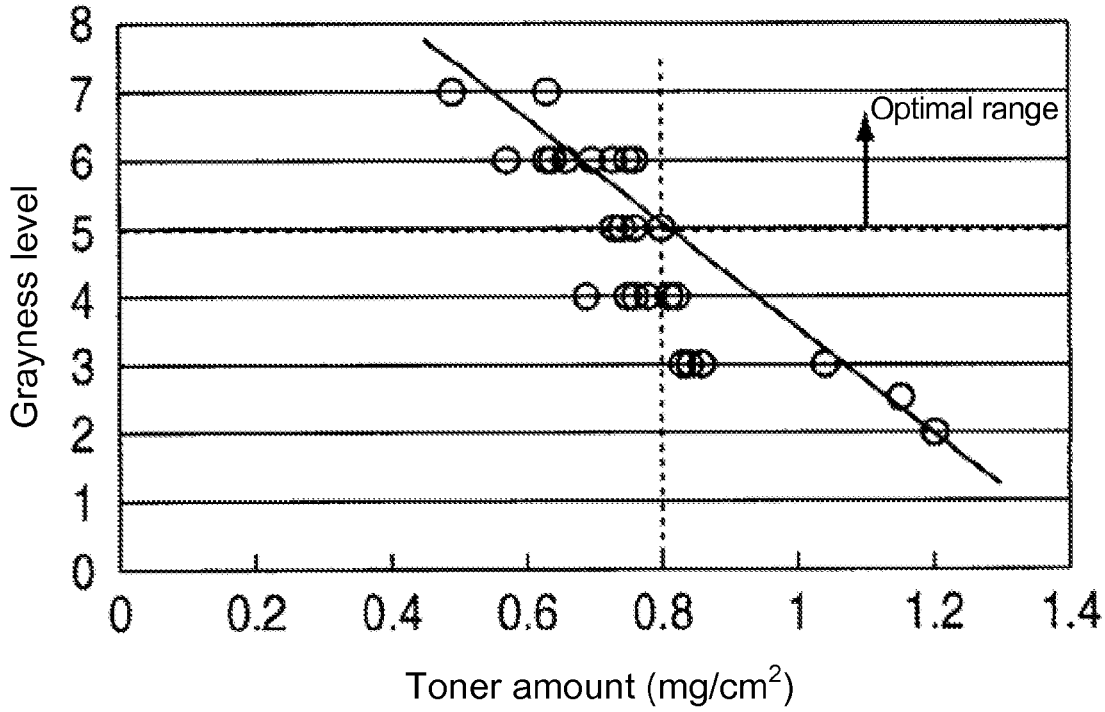
FIG. 6 is a graph showing a relationship between the toner amount on the developing roller and a grayness level of the image forming apparatus according to the first embodiment of the present invention.

A relationship between the toner amount on the developing roller 21 and a grayness level of the image forming apparatus 1 will be explained next. FIG. 6 is a graph showing the relationship between the toner amount on the developing roller 21 and the grayness level of the image forming apparatus 1 according to the first embodiment of the present invention.

In the experiment, the grayness level represented a printing performance and a uniformity of dots. More specifically, an image of 2 by 2 was formed at a resolution of 600 dpi, and the uniformity of dots on the printing sheet was categorized into ten levels. A higher level represented better uniformity of dots, and a lower level represented poor uniformity of dots.

More specifically, when the grayness level was 10, dots were uniformly formed over an entire printing area of the printing sheet. On the other hand, when the grayness level was 1, only small dots were randomly formed with partial blank spots over the entire printing area of the printing sheet. The grayness level was visually determined according to a standard chart and the like.

As a standard of the printing performance, when the grayness level was greater than 5, it was possible to obtain good printing performance. On the other hand, when the grayness level was smaller than 5, dots were randomly formed with partial blank spots, and it was difficult to obtain good printing performance.

As shown in FIG. 6, when the toner amount was greater than 0.8 mg/cm$^2$, the grayness level was smaller than 4. On the other hand, when the toner amount was smaller than 0.8 mg/cm$^2$, although the grayness level was smaller than 4 in some cases, the grayness level was generally greater than 5. From the result, it is evident that the grayness level is significantly dependent on the toner amount.

More specifically, when the toner amount on the surface of the developing roller 21 increased, the grayness level was deteriorated. When the developing roller 21 attached a large amount of toner to the photosensitive drum 15, an image formed on the printing sheet tended to be blurred due to an excessive amount of toner.

According to the results shown in FIG. 6, in order to obtain the grayness level greater than 5, it was necessary to maintain the toner amount on the developing roller 21 between 0.3 mg/cm$^2$ and 0.8 mg/cm$^2$.

Accordingly, in the embodiment, the surface roughness of the developing roller 21 is determined such that the toner amount is within the range to obtain the grayness level greater than 5 according to the surface temperature of the developing roller 21 shown in FIG. 4. More specifically, in the case of the developing roller 21 having the surface temperature greater than 45° C., the developing roller 21 has the surface roughness of 2 μm. In the case of the developing roller 21 having the surface temperature smaller than 45° C., the developing roller 21 has the surface roughness of 4.2 μm. That is, in the case of the developing roller 21 at the position 1, the position No. 2, or the position No. 3 having the surface temperature greater than 45° C., the developing roller 21 has the surface roughness of 2 μm.

FIG. 7 is a table showing evaluation results of the image forming apparatus 1 according to the first embodiment of the present invention. In the evaluation, the developing roller 21 was compared with comparative examples No. 1 to No. 4 with respect to the grayness level and the blurred image according to the toner amount.

In the evaluation, the image forming apparatus 1 performed a continuous printing operation for printing 2,000 sheets with a print duty of 1.6%. When the image forming apparatus 1 performed the continuous printing operation more than 2,000 sheets with a low print duty, the grayness level tended to decrease. Further, the image forming apparatus 1 performed the continuous printing operation more than 5,000 sheets, the surface of the developing roller 21 was worn out due to prolonged friction, thereby making it difficult to increase the toner amount and deteriorating the grayness level.

In the comparative examples No. 1 to No. 4, image forming units were arranged at the position No. 1 to the position No. 4, and a developing roller of each of the image forming units had a surface roughness of 4.2 μm.

As shown in FIG. 7, the developing roller 21 arranged at the position No. 1 had the surface roughness of 2.0 μm, smaller than the surface roughness of 4.2 μm in the comparative example No. 1. Further, the toner amount was 0.73 mg/cm$^2$ after the continuous printing operation of 2,000 sheets, smaller than that in the comparative example No. 1, and the grayness level was 6.

As shown in FIG. 7, the developing roller 21 arranged at the position No. 2 had the surface temperature lower than that of the developing roller 21 arranged at the position No. 1 by about 5° C. Accordingly, the toner amount was 0.7 mg/cm$^2$, smaller than that of the developing roller 21 arranged at the position No. 1. As compared with the comparative example No. 2 at the position No. 2, although the surface temperature was the same, the developing roller 21 arranged at the position No. 2 had the surface roughness of 2.0 μm, smaller than the surface roughness of 4.2 μm in the comparative example No. 2. Accordingly, the grayness level was improved from 4 to 7.

As shown in FIG. 7, the developing roller 21 arranged at the position No. 3 had the surface temperature lower than that of the developing roller 21 arranged at the position No. 1 by about 7° C. Further, the toner amount was 0.6 mg/cm$^2$. As compared with the comparative example No. 3 at the position No. 3, although the surface temperature was the same, the developing roller 21 had the surface roughness of 2.0 μm, smaller than the surface roughness of 4.2 μm in the comparative example No. 3. Accordingly, the grayness level was improved from 6 to 8.

As shown in FIG. 7, in the comparative example No. 4, the developing roller 21 arranged at the position No. 4, the farthest position from the fixing unit 9, had the surface roughness of 4.2 μm. However, the surface temperature was lower than those of other examples, and the toner amount was 0.66 mg/cm$^2$, lower than 0.8 mg/cm$^2$, i.e., the standard level shown in FIG. 5. The grayness level was 7.

If the developing roller 21 in the comparative example No. 4 has a smaller surface roughness, the toner amount may become lower than 0.3 mg/cm$^2$, at which the print density on the printing sheet may become too low, thereby causing a printing problem such as a blurred image. For the reason, in the embodiment, the developing roller 21 at the position No. 4 has the surface roughness of 4.2 μm. i.e., the normal level.

As described above, in the embodiment, the developing roller 21 at each of the position 1 to the position No. 3 has the surface roughness of 2.0 μm, smaller than the normal level of the surface roughness of 4.2 μm. If the developing roller 21 has a smaller surface roughness, the toner amount may become lower, thereby lowering the print density. However, as shown in FIG. 7, the surface temperature of the developing roller 21 increases during the printing operation, so that it is possible to prevent the print density from lowering.

As described above, the surface roughness of the developing roller 21 decreases, so that it is possible to prevent the toner amount from increasing due to an increased surface temperature caused by heat of the fixing unit 9. Accordingly, it is possible to attach a proper amount of toner to the developing roller 21, thereby preventing print quality from lowering due to an increased toner amount and performing the printing operation stably.

In the embodiment described above, it is configured such that the developing roller 21 with the surface temperature lower than 45° C. has the surface roughness smaller than the normal level. Alternatively, as shown in the comparative example No. 3, in which the developing roller 21 at the position No. 3 with the surface temperature of 45° C. had the grayness level of 6, the developing roller 21 with the surface temperature lower than 47° C. instead of 45° C. may have the surface roughness smaller than the normal level.

In the embodiment, the image forming unit 8*c* retaining toner in cyan is arranged at the first position (the position No. 1) as a first image forming portion. The image forming unit 8*k* retaining toner in black is arranged at the fourth position (the position No. 4) as a second image forming portion. The present invention is not limited to the configuration. The first image forming portion may be the image forming unit 8*m* retaining toner in magenta arranged at the second position (the position No. 2) or the image forming unit 8*y* retaining toner in yellow arranged at the third position (the position No. 3). The second image forming portion may be the image forming unit 8*m* retaining toner in magenta arranged at the second position (the position No. 2) or the image forming unit 8*y* retaining toner in yellow arranged at the third position (the position No. 3).

Further, in the embodiment, the developing roller 21*k* is disposed in the image forming unit 8*k* as the developing member. The developing roller 21*k* has the surface roughness greater than that of the developing rollers 21*y*, 21*m*, and 21*c*. The present invention is not limited to the configuration. The surface roughness may be determined according to the surface temperature of the developing roller 21 when heated up, or the distance from the fixing unit 9.

Further, in the embodiment, the developing rollers 21*c*, 21*m*, 21*y* and 21*k* are disposed in the image forming units 8*c*, 8*m*, 8*y* and 8*k* at the first to fourth positions in the order of close proximity to the fixing unit 9. The developing roller 21 at a position nearer the fixing unit 9 has transportability of toner or developer greater than that of the developing roller 21 at a position farther from the fixing unit 9. The transportability of toner is defined as ability of the developing roller 21 for supporting and transporting toner as developer to the photosensitive drum 15, and may be substantially equivalent to the toner amount.

Second Embodiment

A second embodiment of the present invention will be explained next. In the second embodiment, the roller main body 31 or the conductive elastic member has a hardness (an elastic layer hardness) of 70° according to the Asker C-type measurement device.

When the printing operation is repeatedly performed, the surface temperature of the developing roller 21 of the image forming unit 8 increases due to heat from the fixing unit 9 or frictional heat through contacting with the photosensitive drum 15. When the surface temperature of the developing roller 21 increases, the roller main body 31 tends to thermally expand. Accordingly, the roller main body 31 is pressed against the photosensitive drum 15 with an increased contact pressure, and toner tends to be charged through friction (toner frictional charging property) to a larger extent, thereby further increasing the toner amount of the developing roller 21.

Further, when the developing roller 21 is pressed against the photosensitive drum 15 with an increased contact pressure, toner tends to be deteriorated due to an increased stress, thereby causing a printing problem such as a blurred image, a low printing density, an unclear image, and the like.

To this end, in the second embodiment, in the image forming unit 8 arranged at the position No. 1, where an influence of heat from the fixing unit 9 is greatest, the roller main body 31 of the developing roller 21 has the hardness greater than that of the roller main body 31 of the developing roller 21 in the image forming unit 8 at other positions. Accordingly, even when the roller main body 31 thermally expands, it is possible to minimize the increase in the contact pressure, thereby maintaining image quality. More specifically, the roller main body 31 of the developing roller 21 arranged at the position No. 1 has the elastic layer hardness of 70°.

An experiment for evaluating the image forming apparatus 1 will be explained next. FIG. 8 is a table showing evaluation results of the image forming apparatus 1 according to the second embodiment of the present invention.

As shown in FIG. 8, the evaluation results show the surface roughness, the toner amount determined according to the elastic layer hardness, and the grayness level of the developing roller 21 arranged at the position No. 1. More specifically, the developing roller 21 in the second embodiment is compared with a modified example of the developing roller 21 in the second embodiment, the developing roller 21 in the first embodiment, and the developing roller 21 in the comparative example No. 1.

As shown in FIG. 8, the developing roller 21 in the second embodiment had the surface roughness of 2.0 μm and the elastic layer hardness of 70°. More specifically, as compared with the developing roller 21 in the comparative example No. 1, which had the surface roughness of 4.2 μm and the elastic layer hardness of 78°, the developing roller 21 in the second embodiment had the surface roughness smaller by 2.2 μm and the elastic layer hardness smaller by 8°. Accordingly, as compared with the developing roller 21 in the comparative example No. 1, the toner amount was smaller by 0.24 mg/cm$^2$ and the grayness level was improved to 7 from 3 in the comparative example No. 1.

Further, as compared with the developing roller 21 in the first embodiment, which had the surface roughness of 2.0 μm and the elastic layer hardness of 78°, the developing roller 21 in the second embodiment had the elastic layer hardness smaller by 8°. Accordingly, as compared with the developing roller 21 in the first embodiment, the toner amount was smaller by 0.11 mg/cm$^2$ and the grayness level was improved to 7 from 6 in the first embodiment.

In the modified example of the second embodiment, the developing roller 21 had the surface roughness of 4.2 μm and the elastic layer hardness of 70°. More specifically, as compared with the developing roller 21 in the second embodiment, the developing roller 21 in the modified example of the second embodiment had the surface roughness greater by 2.2 μm. Accordingly, as shown in FIG. 8, the toner amount was greater by 0.05 mg/cm$^2$ as compared with the second embodiment.

Further, as compared with the developing roller 21 in the first embodiment, the developing roller 21 in the modified example of the second embodiment had the greater surface roughness and the elastic layer hardness smaller by 8°. Accordingly, as compared with the developing roller 21 in the first embodiment, the toner amount was smaller by 0.06 mg/cm$^2$ and the grayness level was improved with the normal surface roughness. More specifically, even the developing roller 21 had the normal surface roughness, when the developing roller 21 had the smaller elastic layer hardness, it was possible to reduce the toner amount and improve the grayness level.

As described above, in the second embodiment, the developing roller 21 has the smaller elastic layer hardness. Accordingly, in addition to the effect in the first embodiment, it is possible to minimize the thermal expansion of the developing roller 21 and the increase in the contact pressure of the developing roller 21 relative to the photosensitive drum 15 due to the temperature increase caused by heat of the fixing unit 9. As a result, it is possible to prevent toner from being deteriorated, thereby preventing a printing problem.

Further, in the second embodiment, the developing roller 21 has the smaller elastic layer hardness. Accordingly, it is possible to reduce the toner amount attached to the developing roller 21. As a result, even when the developing roller 21 has the normal surface roughness, it was possible to stably perform the printing operation on the printing sheet.

It is noted that when the developing roller 21 at the second farthest position, the third farthest position, or the farthest position has the smaller elastic layer hardness, it is possible to minimize the thermal expansion of the developing roller 21 and the increase in the contact pressure of the developing roller 21 relative to the photosensitive drum 15 due to the temperature increase caused by heat of the fixing unit 9. However, when the developing roller 21 has the smaller elastic layer hardness, it is difficult to polish the developing roller 21, thereby increasing a processing cost. Accordingly, it is preferred that only the developing roller 21 at the position where the influence of hest is great has the smaller elastic layer hardness.

Third Embodiment

A third embodiment of the present invention will be explained next. In the third embodiment, the image forming unit 8 arranged at the farthest position from the fixing unit 9 uses toner in yellow. More specifically, the image forming unit 8*y* retaining toner in yellow is arranged to the position No. 1 (refer to the first embodiment). Components in the third embodiment similar to those in the first and second embodiments are designated with the same reference numerals, and explanations thereof are omitted.

Figure 9:
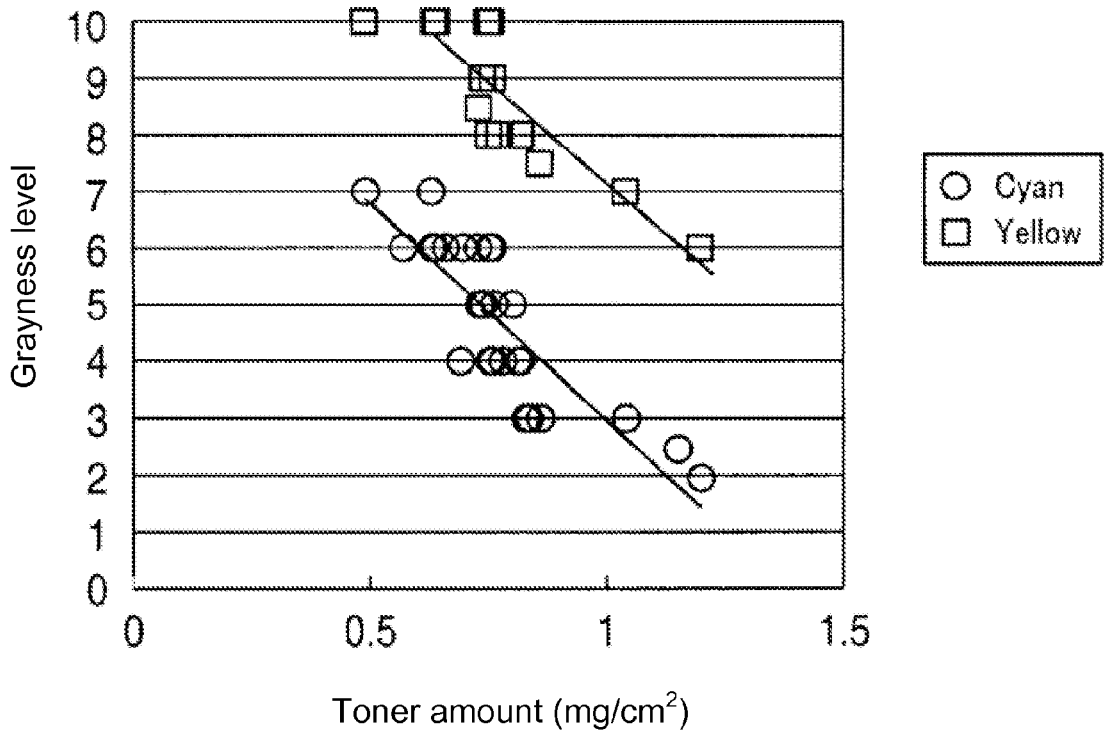
FIG. 9 is a graph showing a relationship between a toner amount on a developing roller and a grayness level of an image forming apparatus according to a third embodiment of the present invention.

An experiment for evaluating the image forming apparatus 1 will be explained next. FIG. 9 is a graph showing a relationship between the toner amount on the developing roller 21 and the grayness level of the image forming apparatus 1 according to the third embodiment of the present invention. More specifically, in the experiment, toner in yellow of the image forming unit 8*y* was compared with toner in cyan of the image forming unit 8*c* at the nearest position to the fixing unit 9.

In general, when the image forming apparatus 1 performs the printing operation on the printing sheet using toner in yellow, it is difficult to visually recognize an image printed in yellow. Accordingly, as shown in FIG. 9, as compared with cyan, even when the toner amount on the developing roller 21 is the same as that in cyan, the grayness level in the case of yellow tends to be better. Accordingly, in the third embodiment, the image forming unit 8 arranged at the farthest position from the fixing unit 9 uses toner in yellow, thereby improving the grayness level.

FIG. 10 is a table showing evaluation results of the image forming apparatus 1 according to the third embodiment of the present invention.

As shown in FIG. 10, the evaluation results show the toner amount, the grayness level, and nip marks of the developing roller 21 in the third embodiment. More specifically, when the developing roller 21 is placed in a state that the developing roller 21 is pressed against the photosensitive drum 15 for a prolonged period of time, the roller main body 31 of the developing roller 21 tends to have a recessed mark due to permanent deformation. When the roller main body 31 of the developing roller 21 has such a recess mark, toner tends to attach to the recess mark in a larger amount, thereby causing a lateral black streak when the printing operation is performed on the printing sheet. The lateral black streak is called the nip mark.

In general, the developing roller 21 is formed of a material capable of suppressing permanent deformation. However, when the developing roller 21 has a smaller elastic layer hardness, the developing roller 21 tends to have permanent deformation. Further, when the developing roller 21 is pressed against the photosensitive drum 15 for a prolonged period of time, the roller main body 31 of the developing roller 21 tends to have larger permanent deformation, thereby becoming more prone to the nip mark.

In the experiment, after the image forming unit 8 was placed at a temperature of 50° C. for one month, the image forming apparatus 1 performed the printing operation. The lateral black streak on the printing sheet was visibly observed according to a standard chart generated in advance. When the lateral black streak was not visible, the nip mark was designated at a level of 10. When the lateral black streak became more visible, the nip mark was designated at a lower level.

As shown in FIG. 10, in the third embodiment, the image forming unit 8 arranged at the position No. 1 used toner in yellow, and the developing roller 21 had the surface roughness of 2.0 μm and the elastic layer hardness of 70°. In the first embodiment, the image forming unit 8 arranged at the position No. 1 used toner in cyan, and the developing roller 21 had the surface roughness of 2.0 μm and the elastic layer hardness of 78°. In the second embodiment, the image forming unit 8 arranged at the position No. 1 used toner in cyan, and the developing roller 21 had the surface roughness of 2.0 μm and the elastic layer hardness of 70°. In the comparative example No. 1, the image forming unit 8 arranged at the position No. 1 used toner in cyan, and the developing roller 21 had the surface roughness of 4.2 μm and the elastic layer hardness of 78°.

As shown in FIG. 10, the developing roller 21 in the second embodiment had the elastic layer hardness of 70° smaller than that of the developing roller 21 in the first embodiment or the comparative example No. 1. Accordingly, the nip mark was the level of 8, and the lateral black streak was more visible on the printing sheet.

As shown in FIG. 10, in the third embodiment, the image forming unit 8 used toner in yellow, and the nip mark was the level of 10, thereby improving the lateral black streak due to the nip mark as compared with the second embodiment. More specifically, when the image forming unit 8 uses toner in yellow, it is possible to prevent deterioration or damage due to friction of toner, thereby improving image quality.

As described above, in the third embodiment, the image forming unit 8 arranged at the farthest position from the fixing unit 9 uses toner in yellow. Accordingly, in addition to the effect in the second embodiment, even when the developing roller 21 has the nip mark, the lateral black streak becomes less visible, thereby improving image quality.

The disclosure of Japanese Patent Application No. 2010-002333, filed on Jan. 7, 2010, is incorporated in the application.

While the invention has been explained with reference to the specific embodiments of the invention, the explanation is illustrative and the invention is limited only by the appended claims.

What is claimed is:

1. An image forming apparatus comprising:

a first image forming portion for forming a developer image, said first image forming portion including a first image supporting member for forming a static latent image and a first developing member for attaching developer to the static latent image;

a second image forming portion for forming a developer image, said second image forming portion including a second image supporting member for forming a static latent image and a second developing member for attaching developer to the static latent image;

a transfer portion for transferring the developer image to a printing medium; and a fixing unit for fixing the developer image to the printing medium, said fixing unit being disposed at a position closer to the first image forming portion relative to the second image forming portion, wherein said first developing member has a surface roughness smaller than that of the second developing member, and said first image forming portion is disposed at an upstream side of the fixing unit and at a downstream side of the second image forming portion in a transportation direction of the printing medium.

2. The image forming apparatus according to claim 1, wherein said second image forming portion is disposed at a farthest position from the fixing unit.

3. The image forming apparatus according to claim 1, wherein said first developing member and said second developing member are arranged to attach toner as the developer in a range between 0.3 mg/cm$^2$ and 0.8 mg/cm$^2$.

4. The image forming apparatus according to claim 1, wherein said first developing member is arranged to attach the developer at a first surface temperature greater than a specific level, and said second developing member is arranged to attach the developer at a second surface temperature smaller than the specific level.

5. The image forming apparatus according to claim 1, wherein said first developing member is arranged to attach the developer in yellow.

6. The image forming apparatus according to claim 1, wherein said first developing member and said second developing member are formed of a first developing roller and a second developing roller, respectively.

7. The image forming apparatus according to claim 1, wherein said first developing member is formed of a first conductive shaft and a first conductive elastic member, and said second developing member is formed of a second conductive shaft and a second conductive elastic member.

8. An image forming apparatus comprising:

a first image forming portion for forming a developer image, said first image forming portion including a first image supporting member for forming a static latent image and a first developing member for attaching developer to the static latent image;

a second image forming portion for forming a developer image, said second image forming portion including a second image supporting member for forming a static latent image and a second developing member for attaching developer to the static latent image;

a transfer portion for transferring the developer image to a printing medium; and a fixing unit for fixing the developer image to the printing medium, said fixing unit being disposed at a, position closer to the first image forming portion relative to the second image forming portion, wherein said first developing member has a hardness smaller than that of the second developing member, and said first image forming portion is disposed at an upstream side of the fixing unit and at a downstream side of the second image forming portion in a transportation direction of the printing medium.

9. The image forming apparatus according to claim 8, wherein said first developing member and said second developing member are arranged to attach toner as the developer in a range between 0.3 mg/cm$^2$ and 0.8 mg/cm$^2$.

10. The image forming apparatus according to claim 8, wherein said first developing member is arranged to attach the developer at a first surface temperature greater than a specific level, and said second developing member is arranged to attach the developer at a second surface temperature smaller than the specific level.

11. The image forming apparatus according to claim 8, wherein said first developing member is arranged to attach the developer in yellow.

12. The image forming apparatus according to claim 8, wherein said first developing member and said second developing member are formed of a first developing roller and a second developing roller, respectively.

13. The image forming apparatus according to claim 8, wherein said first developing member is formed of a first conductive shaft and a first conductive elastic member, and said second developing member is formed of a second conductive shaft and a second conductive elastic member.

* * * * *